US008105252B2

(12) United States Patent
Rousso

(10) Patent No.: US 8,105,252 B2
(45) Date of Patent: Jan. 31, 2012

(54) DEVICE FOR PROVIDING INTERMITTENT COMPRESSION TO A LIMB

(76) Inventor: Benny Rousso, Rishon LeZion (IL)

( * ) Notice: Subject to any disclaimer, the term of this patent is extended or adjusted under 35 U.S.C. 154(b) by 1238 days.

(21) Appl. No.: 11/575,722

(22) PCT Filed: Sep. 29, 2005

(86) PCT No.: PCT/IL2005/001057

§ 371 (c)(1),
(2), (4) Date: Mar. 21, 2007

(87) PCT Pub. No.: WO2006/035449

PCT Pub. Date: Apr. 6, 2006

(65) Prior Publication Data

US 2008/0097268 A1 Apr. 24, 2008

(30) Foreign Application Priority Data

Sep. 29, 2004 (IL) ..... 164360

(51) Int. Cl.
*A61H 7/00* (2006.01)

(52) U.S. Cl. ..... 601/134; 601/84; 601/133

(58) Field of Classification Search ..... 601/41–44, 601/71, 74, 79, 97, 101, 132, 133, 143, 144, 601/147, 148, 149, 151, DIG. 20, 134; 606/201, 606/202, 203
See application file for complete search history.

(56) References Cited

U.S. PATENT DOCUMENTS

| | | | | |
|---|---|---|---|---|
| 718,766 | A | 1/1903 | Ingram | |
| 1,366,537 | A * | 1/1921 | Masse | 185/44 |
| 1,384,272 | A * | 7/1921 | Nickerson | 185/43 |
| 1,472,936 | A * | 11/1923 | Pitman | 185/39 |
| 2,118,699 | A | 5/1938 | Chappell | |
| 3,804,084 | A | 4/1974 | Lehman | |
| 3,853,121 | A | 12/1974 | Mizrachy et al. | |
| 4,004,579 | A | 1/1977 | Dedo | |
| 4,243,039 | A | 1/1981 | Aginsky | |
| 4,333,181 | A | 6/1982 | Corriero | |
| 4,396,010 | A | 8/1983 | Arkans | |
| 4,542,649 | A * | 9/1985 | Charbonneau et al. | 73/168 |
| 4,732,140 | A | 3/1988 | Stoffregen | |
| 4,770,164 | A | 9/1988 | Lach et al. | |
| 4,928,674 | A | 5/1990 | Halperin et al. | |
| 4,982,732 | A | 1/1991 | Morris | |
| 5,009,222 | A | 4/1991 | Her | |
| 5,277,697 | A | 1/1994 | France et al. | |
| 5,334,131 | A | 8/1994 | Spector et al. | |
| 5,399,153 | A | 3/1995 | Caprio et al. | |
| 5,407,418 | A | 4/1995 | Szpur | |

(Continued)

FOREIGN PATENT DOCUMENTS

| | | |
|---|---|---|
| CH | 1187824 | 11/1936 |

(Continued)

*Primary Examiner* — Justine Yu
*Assistant Examiner* — Latoya M Louis

(57) ABSTRACT

The present invention provides a device for providing intermittent compression to a limb, the device comprising, an at least one energy reservoir and an at least one compressing means for compressing the limb, wherein the energy stored in the at least one energy reservoir is pre-stored in the energy reservoir and is directly transformed to provide intermittently compression on the limb. The energy reservoir provides a single energy transformation from energy stored in the reservoir to energy used to compress intermittently the limb. Optionally, the energy stored in the reservoir also provides the energy for a mechanism controlling the intermittent operation of the device and the release of excess energy from the device.

24 Claims, 10 Drawing Sheets

U.S. PATENT DOCUMENTS

| | | | | |
|---|---|---|---|---|
| 5,454,831 | A | 10/1995 | McEwen | |
| 5,472,413 | A | 12/1995 | Detty | |
| 5,513,658 | A | 5/1996 | Goseki | |
| 5,575,761 | A | 11/1996 | Hajianpour | |
| 5,738,637 | A | 4/1998 | Kelly et al. | |
| 5,769,801 | A | 6/1998 | Tumey et al. | |
| 5,865,776 | A | 2/1999 | Springs | |
| 5,873,848 | A | 2/1999 | Fulkerson | |
| 6,010,470 | A | 1/2000 | Albery et al. | |
| 6,135,116 | A | 10/2000 | Vogel et al. | |
| 6,174,295 | B1 | 1/2001 | Cantrell et al. | |
| 6,231,532 | B1 | 5/2001 | Watson et al. | |
| 6,290,662 | B1 | 9/2001 | Morris et al. | |
| 6,478,757 | B1 | 11/2002 | Barak | |
| 6,494,852 | B1 | 12/2002 | Barak et al. | |
| 6,551,280 | B1 | 4/2003 | Knighton et al. | |
| 6,616,620 | B2 | 9/2003 | Sherman et al. | |
| 6,780,163 | B1 | 8/2004 | Krusenklaus | |
| 7,004,919 | B2 | 2/2006 | Gaylord et al. | |
| 7,025,738 | B2 | 4/2006 | Hall | |
| 2002/0026131 | A1 | 2/2002 | Halperin | |
| 2002/0169399 | A1 | 11/2002 | Rastegar et al. | |
| 2002/0177793 | A1 | 11/2002 | Sherman et al. | |
| 2004/0073146 | A1 * | 4/2004 | Weintraub et al. | 601/134 |
| 2005/0043657 | A1 | 2/2005 | Couvillon | |
| 2005/0267387 | A1 | 12/2005 | Baldauf et al. | |
| 2006/0047232 | A1 | 3/2006 | Bourne et al. | |
| 2006/0074362 | A1 | 4/2006 | Rousso et al. | |
| 2006/0122546 | A1 | 6/2006 | Rousso | |
| 2007/0055188 | A1 | 3/2007 | Avni | |
| 2007/0173886 | A1 | 7/2007 | Rousso et al. | |
| 2008/0015630 | A1 | 1/2008 | Rousso | |
| 2008/0039752 | A1 | 2/2008 | Rousso | |
| 2008/0097268 | A1 | 4/2008 | Rousso | |
| 2008/0146980 | A1 | 6/2008 | Rousso et al. | |
| 2008/0255494 | A1 | 10/2008 | Rousso et al. | |
| 2008/0269543 | A1 | 10/2008 | Rousso | |
| 2009/0118651 | A1 | 5/2009 | Rousso et al. | |

FOREIGN PATENT DOCUMENTS

| | | |
|---|---|---|
| DE | 19815487 | 10/1999 |
| WO | WO97/04820 | 2/1997 |
| WO | WO00/23034 | 4/2000 |
| WO | WO00/27334 | 5/2000 |
| WO | WO01/32124 | 5/2001 |
| WO | WO01/91364 | 11/2001 |
| WO | WO02/69879 | 3/2002 |
| WO | WO 02/069879 A1 | 9/2002 |
| WO | WO2005/051250 | 6/2005 |
| WO | WO/2005/072674 | 8/2005 |
| WO | WO2005/072674 | 8/2005 |
| WO | WO2005/074376 | 8/2005 |
| WO | WO2005/120424 | 12/2005 |
| WO | WO2005/120500 | 12/2005 |
| WO | WO2005/122269 | 12/2005 |
| WO | WO2006/033114 | 3/2006 |
| WO | WO2006/033115 | 3/2006 |
| WO | WO2006/035449 | 4/2006 |
| WO | WO2006/117771 | 11/2006 |

* cited by examiner

DEVICE FOR PROVIDING INTERMITTENT COMPRESSION TO A LIMB

RELATED APPLICATION

The present invention claims priority from Israeli patent application serial No. 164369 titled: "A DEVICE FOR PROVIDING INTERMITTENT COMPRESSION TO A LIMB", filed on Sep. 29, 2004.

BACKGROUND OF THE INVENTION

1. Field of the Invention

The present invention generally relates to a device providing intermittent compression, in general, and to a device providing intermittent compression on a limb, in particular.

2. Discussion of the Related Art

Intermittently compression devices worn on limb of a person can be usually used for enhancing the circulation in the limb. A great majority of known devices for applying intermittent compression on limbs are devices that comprise at least one unit encircling a limb and a power unit which generates the energy necessary to provide the intermittent compression. One example is disclosed within U.S. Pat. No. 6,290,662 issued to Morris et al. that provides an inflatable bladder disposed against an extremity such as the upper calf, foot, or hand of a patient, or within a cast. The reference discloses a power unit connected to an energy source for generating air via a pump, said air is then transferred to the bladder such that compressive forces are directed substantially against the body part of the patient when the bladder expands. This and other prior art devices providing intermittent compression on limbs disclose devices that convert one energy such as electrical energy provided by a battery or electricity to a second energy source, such as compressed air, prior to transforming said second energy to a compressive force to be applied to the limb. Thus, such conversions require investing excessive energy for conversion of energy.

There is therefore a need to provide an efficient device that will provide intermittent compression on a limb using less than two energy transformations. There is also a need to provide a cheap, portable and disposable device for self adjusting intermittent compression.

SUMMARY OF THE PRESENT INVENTION

In accordance with one aspect of the present invention there is provided a device for providing intermittent compression to a limb, the device comprising an energy reservoir and compressing means for compressing the limb wherein the energy stored in the energy reservoir is substantially directly transferred to intermittent compression on the limb through the compressing means. The energy is converted in a single step from the energy reservoir to the compressing means or is pre-stored or stored in the energy reservoir is transferred in predetermined portions to the compressing means for intermittent compression of the limb. The energy transfer from the energy reservoir can be regulated. The regulating can comprise the use of one or more valves. The compressing means comprises a pressure gradient profile for transferring the energy stored in the energy reservoir to the limb based on a predetermined pressure gradient profile. The compressing means is associated with the at least one energy reservoir, and the compressing means is associated with an outlet of the energy reservoir. The compressing means can comprise an energy release outlet; the outlet of the energy reservoir can comprise one or more energy release valve, one or more energy release mechanism and an energy release valve. Alternatively, the outlet of the compressing means further comprises an energy release mechanism. The gas passes within the strap through a cavity there within. The strap can comprise one or more chambers. The strap is hollow defining an expansible and contractible space.

The energy reservoir can be a gas chamber or a chamber including energy that can be transformed. The gas within the energy reservoir is compressed. The compressing means for compressing the limb can be a strap encircling the limb, the strap comprising a first end and a second end. The end of said strap is associated with the outlet of the gas chamber. The device may further comprise an energy transfer control mechanism. The energy transfer control mechanism may comprise two or more valves, each of the levers are associated to the closing top, the mechanism provides controlling the gas transportation from the at least one energy reservoir. The device may further comprise an energy release mechanism. The energy reservoir can further comprise one or more charged springs. The energy release mechanism may comprise at least one cogwheel provided with energy from the energy reservoir. The energy release mechanism may comprise one or more cogwheels providing energy to the compressing means. The energy release mechanism may further comprise a pivoted lever associated with the at least one compressing means. The device described above can be portable or disposable, and it can be used for enhancing blood and lymph flow. The energy reservoir may be chargeable, replaceable and/or disposable. The device further comprises a mechanism for applying intermittent squeezing force on the limb.

In accordance with a second aspect of the present invention there is provided a method for providing intermittent compression to a limb, the method comprising providing energy reservoir and compressing means for compressing the limb; transferring the energy stored in the energy reservoir directly to intermittent compression on the limb through the compressing means. The energy in the energy reservoir is pre-stored. The energy stored in the energy reservoir is transferred in predetermined portions to the compressing means for intermittent compression of the limb.

BRIEF DESCRIPTION OF THE DRAWINGS

The present invention will be understood and appreciated more fully from the following detailed description taken in conjunction with the drawings, where part numerals represent like parts, in which.

DETAILED DESCRIPTION OF PREFERRED EMBODIMENTS

Figure 1:
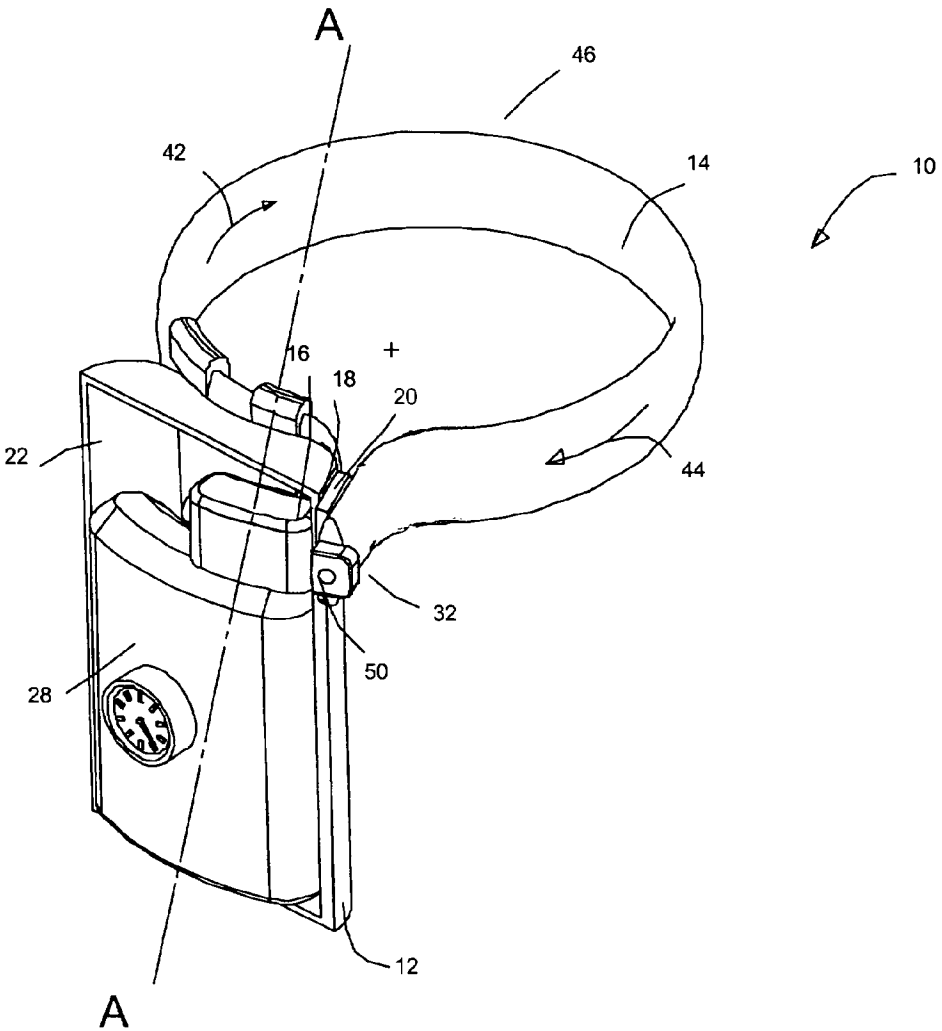
FIG. 1 and FIG. 1A are sectional view of a device for intermittent compression of a limb, according to one preferred embodiment of the present invention.

The present invention provides a device for providing intermittent compression to a limb, the device comprising, an at least one energy reservoir and an at least one compressing means for compressing the limb, wherein the energy stored in the at least one energy reservoir is pre-stored in the energy reservoir and is directly transformed to provide intermittently compression on the limb. The energy reservoir provides a single energy transformation from energy stored in the reservoir to energy used to compress intermittently the limb. Optionally, the energy stored in the reservoir also provides the energy for a mechanism controlling the intermittent operation of the device and the release of excess energy from the device. The present invention is related and claims priority from Israeli patent application serial No. 164369 titled: "A DEVICE FOR PROVIDING INTERMITTENT COMPRESSION TO A LIMB", filed on Sep. 29, 2004, the entire of said application is herewith incorporated by reference to the present application.

Preferably, the invention provides a device for intermittently compressing a limb or any other body part. According to one preferred embodiment the device comprises a strap or a plurality of straps that encircle a limb. The device actuates intermittently compressing forces on a limb. The magnitude of the compressing force applied to during intermittently compressing by the device varies according to the parameters referring to the amount of energy stored within the energy reservoir, the time interval designated for applying the compressing forces on the limb, the compressing means used, the efficiency of transferring the energy from the energy reservoir to the compressing means, as well as other parameters. The energy stored in the energy reservoir may be of any form. For example, the stored energy may be in the form of a compressed gas or a potential mechanical energy stored in a spring. One advantage of the present invention is that there is no need for an energy source to add or fill the energy reservoir from which energy is transferred to intermittently compressing the limb. The device can therefore be portable, small and disposable. It can be used until such time where the energy reservoir has been depleted. It should be emphasized that the energy reservoir allows for multiple operation cycles with no need for a separate power source element. However, it will be realized that the energy reservoir itself may be a chargeable reservoir so as to allow re-charging the reservoir after depletion thereby allowing for further sessions of operation. Another advantage of the present invention is that a single energy reservoir can be used both for transforming the energy stored therein both for providing intermittent compression and controlling of the device's intermittent compression operation and cycle. The advantages of the present invention will be apparent in view of the depiction of the drawings and examples below, in which the preferred embodiment shown is an energy reservoir storing a fluid such as compressed air and the compressing means is an inflatable strap. It will be appreciated that the present invention will likely apply to any other device or mechanism that can store energy and allow-release thereof to enable by a single transformation of said energy to provide intermittent compression to a limb. The stored energy may be in the form of a compressed fluid, a charged spring or energy stored in a battery transformed into electromechanical energy of an electromechanical actuator.

Figure 1A:
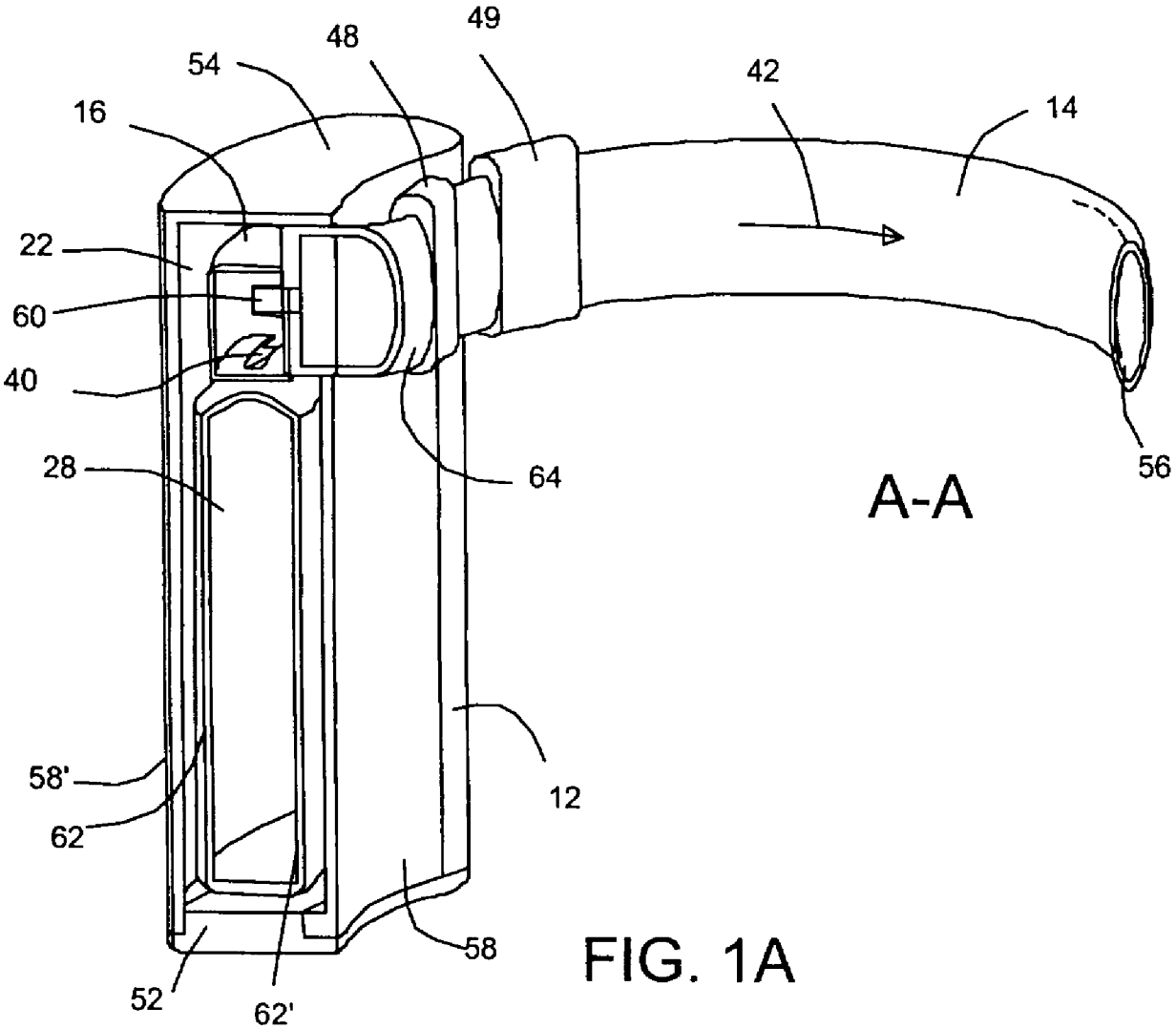

FIG. 1 is top view of a device 10 for intermittent compression of a limb, according to one preferred embodiment of the present invention. FIG. 1A is a cross sectional view of device 10 viewed along line A-A shown in FIG. 1. Device 10 comprises a housing 12 and an inflatable sleeve 14. Housing 12 is shown in FIG. 1 without base 52 and wall 58'. Housing 12 is preferably positioned juxtaposed to the sleeve 14 which encircles the limb providing a circumference 46 to be compressed on the limb of the user of the device. The perimeter of circumference 46 can correlate for example to a calf or an arm of a person, although it may be fitted to any limb, preferably in the extremities. Device 10 can be actuated by a lever mechanism valve 16 enabling the beginning of the release of the energy stored in the energy reservoir 28 within housing 12 to the compressing element. The actuation can be mechanical, electrical, electromagnetic or the like. In the present embodiment when valve 16 is switched to the on/open position, gas or other pressure source preferably generated by a fluid is be released from the reservoir 28 based on the size of the outlet pipe from said reservoir. Reservoir 28 and lever mechanism valve 16 are placed within housing 12. In the present embodiment, reservoir 28 can comprise a canister shaped chamber with entry opening 40, said bottle can resemble a small can of compressed air and preferably fabricated from light metal material and double shield walls 62, 62'. Yet alternatively, the canister may be placed separately on another body part. In one alternative embodiment the reservoir 28 is disposable and can be replaceable when the fluid there within is depleted. Accordingly, reservoir 28 can be extracted from base 52 of housing 12. Base 52 can be removed for extracting reservoir 28 and inserting a new reservoir. Base 52 can be removed by sliding on sliding tracks (not shown) attached to walls 58, 58' of housing 12 or other manner. In another embodiment the entire device is disposable and is for a single use or limited number of uses. The size of the reservoir 28 as well as its housing is determined based on its content and its use, such that if the device is to be operated on public vehicles local rules will dictate aspects of its constructions, such as the material it is manufactured from, the strength of its walls and the like.

Still referring to FIG. 1, in one preferred embodiment the fluid within reservoir 28 is compressed air. According to other embodiments of the present invention other compressible and expendable, inert and non-flammable gasses can be used. The preferred fluid to be used in association with the device will be a compressible and expandable gas, with high flow characteristics once the kinetic energy stored there within is allowed to be released. Such gas will maintain low and as close to room temperatures as possible when compressed and expanded without significant kinetic energy loss or change of state. Such gasses can include Nitrogen, Helium, and Carbon Dioxide and the like. If Carbon Dioxide is used within reservoir 28 it is preferably provided with an initial internal pressure of about 15 Atmospheres. According to other embodiments the initial pressure of reservoir 28 can be between about 4 to about 25 Atm., thus allowing sufficient pressure to operate the device for a predetermined length of time. The device is also constructed such that the rate of diffusion of the gasses used there in is maintained by slow release of the gas from reservoir 28 and the maintaining of the concentration gradient within the device.

In the present embodiment, sleeve 14 is hollow and provides gas exited from reservoir 28 to be transported there through, so as to enable the compression of the limb within circumference 46. Alternatively, the device can include instead or additionally to said sleeve, a strap pulled in and out of housing 12, or a pair of flaps moved towards and out of the compressed limb, or a plate or an inflatable member also applied towards and out of compressed limb, or the like for providing compression to the limb. The sleeve 14 as well as the other compressing elements discussed herein will enable the compressing of the limb within circumference 46 at predetermined intervals for certain period of time to be either predetermined or set by an operator or user of the device. Sleeve 14 is fabricated from substantially non-stretchable nylon or like material and can optionally be put within a sleeve fabricated from synthetic, natural or combination thereof cloth to be applied to the limb itself. Sleeve 14 comprises two ends 32 and 64. End 64 is fixed to entry opening 40 of reservoir 28, while end 32 comprises exit opening 50 and can be attached to housing 12 by a user through the use of a strip of hooks 20 appended to end 32 and appended to corresponding loops 18 placed on housing 12 and provides for the fastening of end 32 to housing 12 with attachable materials such as Velcro. End 64 is attached to housing 12 hooks 48, 49. Persons skilled in the art will appreciate that other methods of closure and opening of the sleeve 14 can be applied in connection with the present invention. Such can include the use of a buckle, an adjustable buckle, a snap, a loop strap and any other attaching means that will enable a quick fastening and release of the sleeve to the housing 12 thereby allowing a user or an operator to quickly wear and remove the device. Opening 56 of sleeve 14 is juxtaposed to exit opening 50, thus providing a gas outlet for the gas circulating within sleeve 14. When released, compressed gas held within reservoir 28 exits reservoir 28 through entry opening 40 to end 64 of sleeve 14. The gas compression entering sleeve 14 is changed from high compression to a lower compression thus achieving greater volume in a relatively short period of time and allowing the quick filling of the volume of space within said sleeve, thus, narrowing the circumference 46 and a quick build up of the pressure gradient on the limb in said circumference. Alternatively, the release of the gas into sleeve 14 can be moderated by a valve (not shown) such that slower gas filling is achieved and a slower build up of the pressure gradient as against the limb is accomplished. The result of narrowing the circumference 46 of is a compression on said limb and the change in the pressure gradient on said limb. The change of gradient pressure, the gradient pressure duration and speed of change of gradient pressure on the limb enable the relief of symptoms associated with ailments associated with peripheral vascular diseases, arterial, venous or combined. Such can include venous stasis, vein thrombosis, diabetic foot, arterial sclerosis, varicose veins, arteriovenous fistula and lymphatic disorders like lymphedema and lipedema. Other ailments associated with orthopedic conditions such as gangrin of the foot, mycosis of the nails, fractures, tendonitis, bursitis and the like.

Still referring to FIG. 1 device 10 provides that the pressure within reservoir 28 and entry opening 40 is substantially larger than the pressure within sleeve 14 and exit opening 50. The variance in pressure within said strap between the areas of entry opening 40 and exit opening 50 is exploited in the preferred embodiment to provide an energy releasing mechanism. Thus, gas entering the sleeve at end 64 is at higher pressure than gas present at the same time at end 32 of the sleeve 14. Gas entering the sleeve will deflate the sleeve 14 until such pressure is built so as to provide a sufficient pressure gradient to compress the limb of the user. In one embodiment of the present invention, the user of the device can manually release gas from reservoir 28 into the sleeve 14 by actuating lever 16. According to this embodiment, the compressed gas within reservoir 28 exits the canister and flows through entry opening 40 via sleeve end 64 into the sleeve 14. Once sufficient gas entered the sleeve 14 and sufficient pressure was built to apply sufficient compression on the limb, the gas exist the sleeve through exit opening 50 via sleeve end 32.

To control the amount of gas entering and exiting the sleeve 14, a self controlled pressure mechanism is provided. The self controlled pressure mechanism comprises a sleeve entry valve 16 and a sleeve exit valve 24. Valves 24, 16 are used as an energy regulating mechanism that exploit the energy transfer between reservoir 28 and sleeve 14. Thus, the valves 24, 16, regulate the energy conversion rate from energy prestored within reservoir 28 to compression force applied by sleeve 14 on said limb. Valves 24, 16 provide the energy transfer in predetermined portions. Said portions of the energy transfer are set according to a pre-designated rate of the intermittent compression desired on the limb. Subject to a pressure gradient profile along the time course of the prestored energy within reservoir 28 the intermittent compression rate on the limb can vary. Thus, according to one embodiment the intermittent compression rate applied by sleeve 14 remains substantially constant in a course of predetermined time interval, alternatively, according to another embodiment the intermittent compression rate decreases in a course of predetermined time interval. In the present embodiment the energy transfer within device 10 is the transfer of high pressure gas within reservoir 28 to sleeve 14. The gas transfer direction within sleeve 14 is indicated by arrows 42 and 44. Since gas is present in reservoir 28 at high pressure it can be used to drive a pneumatic actuated on/off valves to allow intermittent opening and closing of the sleeve entry and exit valves 24, 16. The gas within reservoir 28 provides constant flow of gas at high pressure to the pneumatic actuated on/off valves device which opens and closes intermittently the valves 24, 16. Thus, valve 16 comprises a ball assembly 60 providing the intermittent opening and closing of gas from reservoir 28 to sleeve 14. The valves can be associated with a timing device such as a small battery operated watch or timing mechanism to time the opening or closing of the valves. Said timing device controls the intermittent closing and opening of valves 24, 16. Thus, while valve 16 is open valve 24 is closed. Consequently to the pressure within reservoir 28 said positions of valves provides flow of a portion of gas from reservoir 28 with high pressure to sleeve 14. Said position of valves 24, 16 with a portion of provides a narrowing of the circumference 46 and a quick build up of the pressure gradient on the limb in said circumference. The timing device in turn changes the position of valves 16, 24, thus, closing valve 16 and opening of valve 24. Consequently, said positions of valves 16, 24 causes sleeve 14 to deflate. Thus, reducing the pressure on the limb.

Figure 2:
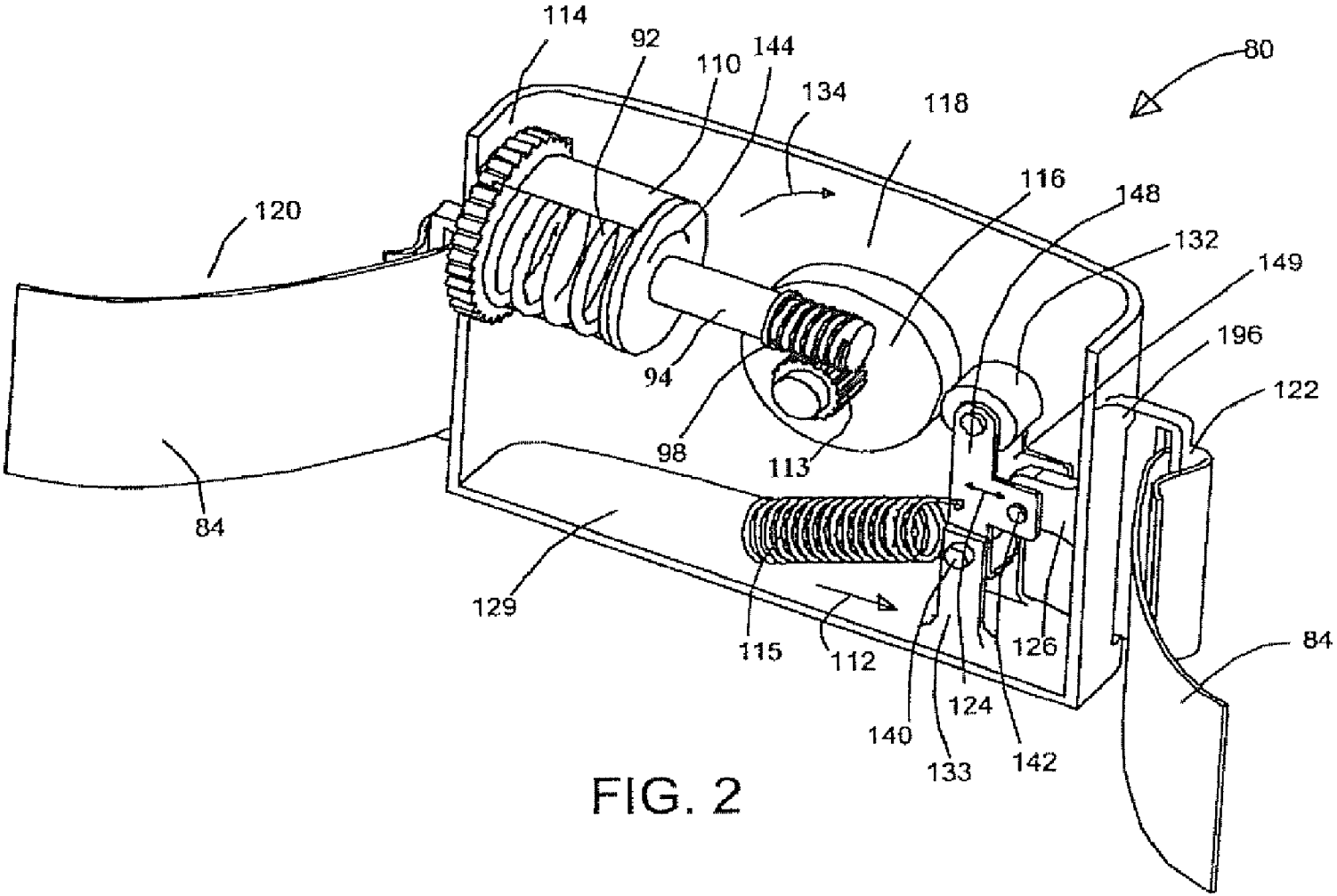
FIG. 2 is a sectional view of a device for intermittent compression of a limb, according to a second preferred embodiment of the present invention.
Figure 4:
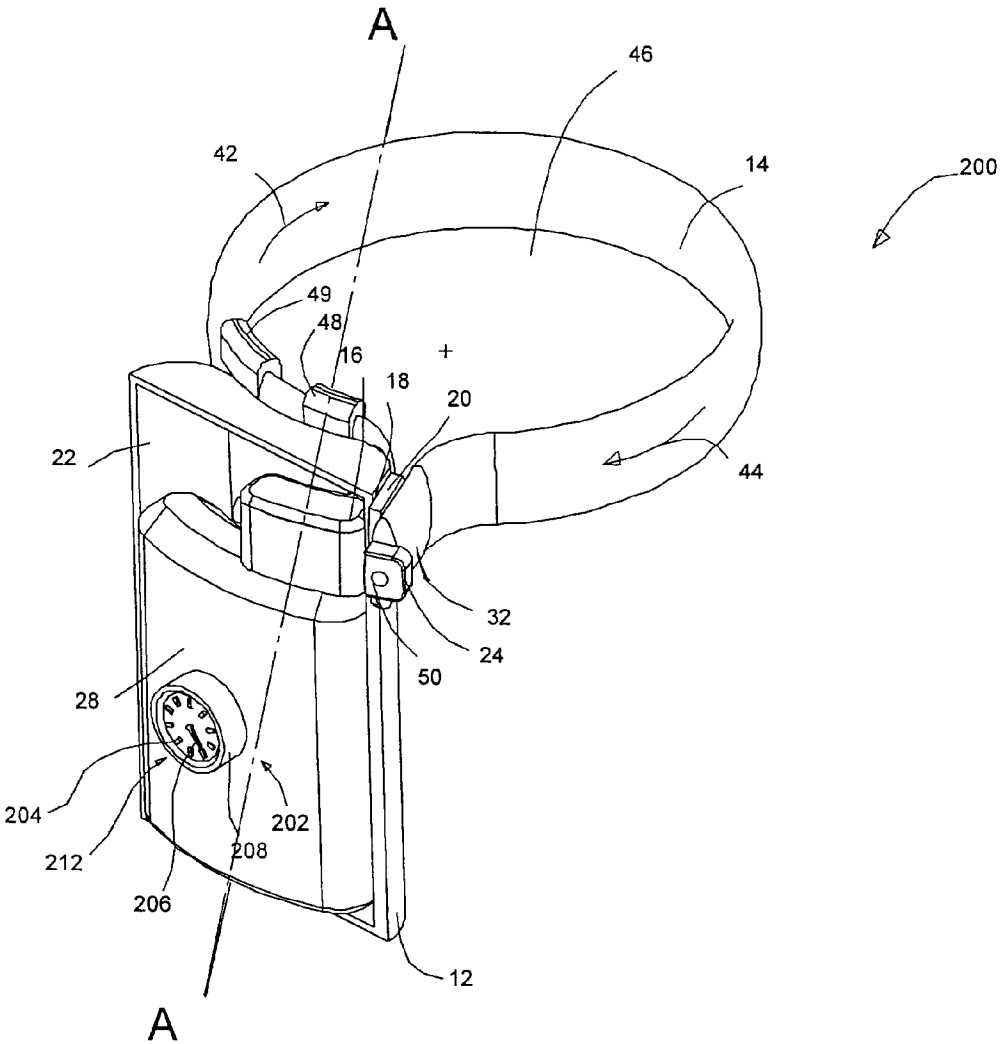
FIGS. 4 and 4A are views of a device for intermittent compression of a limb, according to a fourth preferred embodiment of the present invention.
Figure 4A:
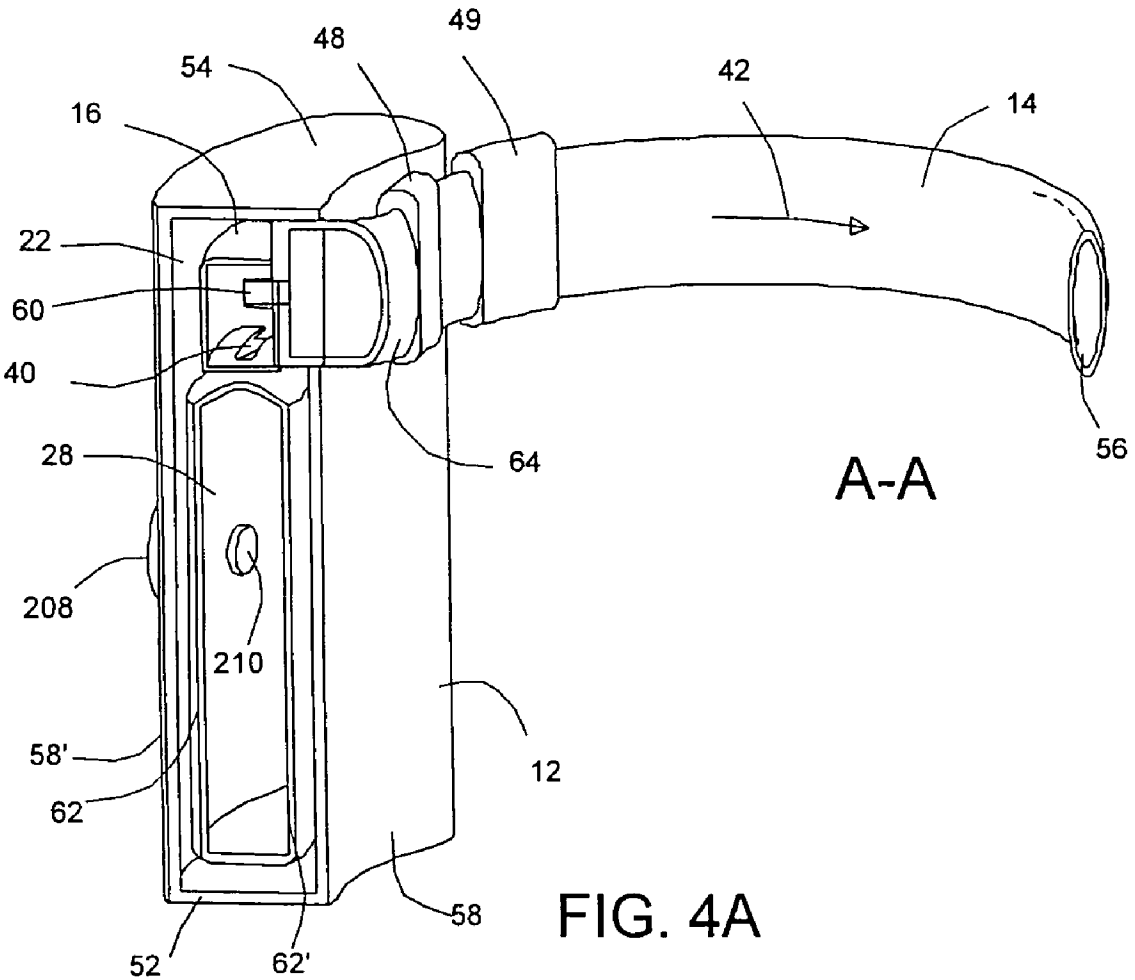

FIGS. 4 and 4A are sectional views of a device for intermittent compression of a limb, according to a further preferred embodiment of the present invention. Device 200 comprises the same elements of device 10 depicted in view of FIGS. 1 and 1A as well as a pressure measuring device 202. Pressure measuring device 202 comprises a pressuring measuring indicator unit 212 and pressure measuring sensor 210. Pressuring measuring indicator unit 212 is positioned on wall 62 of reservoir 28 and due to a opening on wall 58' of housing 12 (not shown) pressuring measuring indicator 212 can be viewed by looking at wall 58'. Thus, providing that indicator 212 can be viewed by a user of device 200 or another person. Pressuring measuring indicator unit 212 comprises a measuring device housing 208, a display unit 204, and a needle 206. Measuring device housing 208 is projecting from wall 62 and is adjacent to correlating opening within wall 58' (not shown). Needle 206 is connected to pressure measuring sensor 210 and indicates the pressure within reservoir 28 by pointing to pressure values on display unit 204. Display unit 204 is an analog displaying unit presenting numbers representing different values of pressure units that can indicate various pressure values possible within reservoir 28. A low pressure value interval wherein the device does not provide the required intermittent pressure on limb can be painted in red or indicate "CHANGE RESERVOIR" (not shown). Thus, a user is notified the time of changing a reservoir, or alternatively, a time to dispose device 200. According to other embodiments a display unit may be a digital display unit showing pressure values correlating to the pressure within reservoir 28. Alternatively, a pressure measuring sensor can be connected to an alarm or LED light, thus, by reaching a predefined pressure threshold an alarm is initiated or a light is lit, respectively, thus notifying a user that the reservoir must be changed or recharged. Additionally, according to still further embodiments a pressure measuring sensor can be replaced with other measuring sensors such as a temperature sensor, a humidity sensor, a combination thereof, and the like. A display unit connected to a measuring sensor may be a time measuring display unit (e.g. a clock) indicating a time interval from the commencement of an intermittent compression until a certain predefined threshold wherein the intermittent compression is ineffective or ceased. Accordingly, the time measuring display unit is connected to a measuring sensor. Thus, upon receiving mechanical force, magnetic force, electrical signal and the like from a measuring sensor the time measuring display unit will measure the time and display it on a display unit that can be viewed by a user. The measuring of the time measuring display unit is ceased according to predefined threshold, e.g. if the pressure within an energy reservoir drops below a predefined value, One skilled in the art can appreciate that according to other embodiment a pressuring measuring indicator unit can be positioned on the top cover 54 of housing 12, on other parts of housing 12, or at a remote position from pressure measuring sensor. According to further embodiments a pressure measuring sensor can be located on sleeve 14, adjacent to valve 16 or 24, or at other locations. FIG. 2 is cross section top view of a second embodiment in accordance to the present invention. The same principles applied to the device depicted in FIG. 1 are applied to the device of FIG. 2. Device 80 comprises a housing 82 and strap 84. Device 80 provides intermittent compression on a limb within circumference 86 (not shown). Housing 82 is positioned juxtaposed to said limb and strap 84 which encircles the limb of a person (not shown) providing substantially an enclosed area or loop. Strap 84 can be fabricated from a synthetic cloth, natural cloth or a combination thereof substantially not stretchable and not irritating to a skin of a person. Nevertheless, device 80 can be placed over a garment such as a sleeve or trousers, thus, providing that any substantially not stretchable material can be used as a fabricating material for strap 84. Strap 84 comprises strap ends 120, 122. Strap end 122 is connected to elongated connector plate 96 enabling the strap to be pulled and released in and out of the housing 82 (not indicated in drawing) by way of a connected pull rod 126 so as to apply intermittent compression to the limb, while strap end 120 is attached to the housing 82 through an attaching means such as the hooks and loops disclosed in association with FIG. 1 or through the use of a buckle 96 the like means which enable a fast release and attachment of the distal strap end and the application of the device on the limb by the user. Pull rod 126 is pivotally connected by pivot 142 to connecting plates 148, 149. Connecting plates are pivotally connected to rounded wheel 132 and to stems 133, 131 (not shown). Pivot 140 connects plates 148, 149 to stems 131, 133. Stems 131, 133 are fixed to wall 129 of housing 82. Housing 82 comprises energy reservoir unit and energy releasing mechanism unit.

Figure 2A:
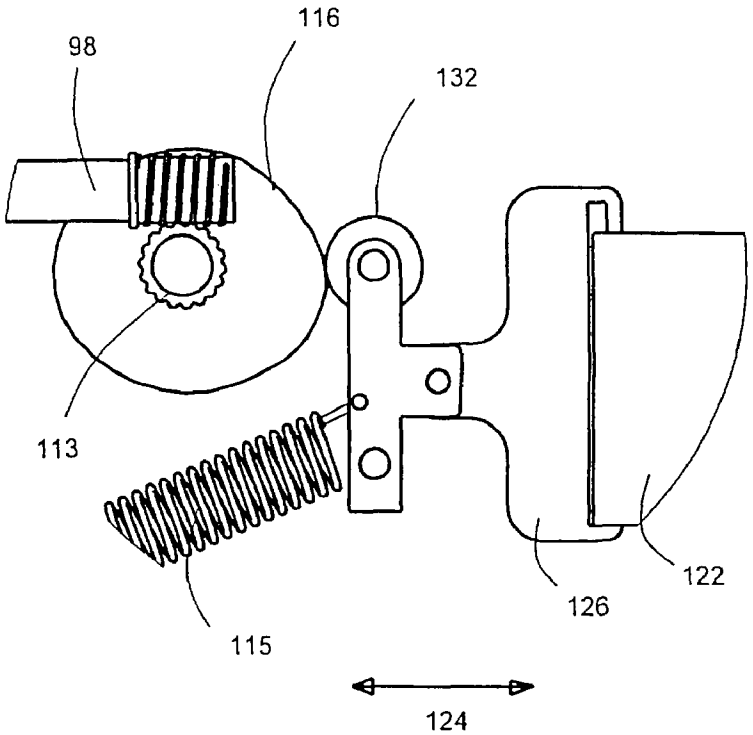
FIGS. 2A, 2B show additional examples of pressure gradient profiles of a device for intermittent compression of a limb.
Figure 2B:
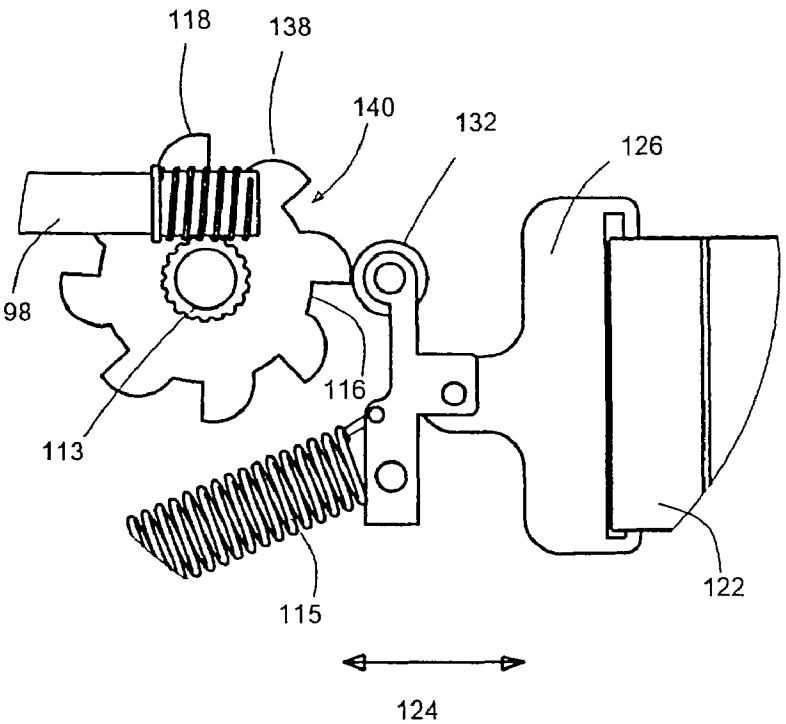

In accordance with this embodiment, energy reservoir unit 110 comprises a charged coil 92 connected to wall 114 of housing 82 at one end and to a plunger 94 at the other end. Arrow 144 indicates the direction of movement of energy reservoir unit 110. While in the preferred embodiment of the present invention the device 80 is disposable, in an alternative embodiment of the present invention, the energy reservoir unit 110 is replaceable when the energy in coil 92 is depleted. Coil 92 converts the stored energy there within to kinetic energy pushing plunger 94. Plunger 94 is pivotally attached to a spirally grooved worm shaft 98. Worm shaft 98 is coupled to vector changing cogwheel 113 that transfers movement energy to cogwheel 116 which turns around its axis and converts the energy released by coil 92 to a circular motion. The circular motion direction of cogwheel 116 is indicated by arrow 134. Cogwheel 113 is squarely connected perpendicular to its surface by an axis to wheel 116 such that each turn of cogwheel 113 will cause a full turn of cogwheel 116. To control the rate of intermittent compression in addition to cogwheels 113, 116 a clutch element can be inserted between said cogwheels to allow the change of speed of cogwheel 116 and the intermittent intervals between one compression and the next. In the embodiment shown in FIG. 2 cogwheel 116 is substantially round having semi circular rounded shaped teeth 118 suitable for allowing pull rod 126 having a pivotally jointed rounded wheel 132 at its distal end to travel on the horizontal plane indicated by arrow 124 in a crankshaft manner thus actuating the plate 96 and the strap 84. Pull rod 126 is connected via axis of jointed rounded wheel 132 to cogwheel 113 by way of a spring 115 allowing pull rod 126 to move horizontally in the direction of arrow 124 maintaining a return force to be applied to pull rod 126 by way of spring 115. The size and shape of wheels 113, 116 and teeth 118 determine the pressure gradient profile to be applied to the limb during the intermittent compression cycle provided by device 80. Thus, rounded shaped teeth 118 provide a linear pressure gradient to be applied to the limb. The use of teeth 118 also enables a relative quick pulling and release of strap 84 by means of release of energy stored in spring 92 and transformation of the released energy into circular motion via worm central shaft 98. Cogwheels 113, 116 preferably turn in the direction indicated by arrow 134 providing angular movement consequently applying a movement of pull rod 126 and in turn the movement of strap 84 in the bi-direction of arrow 124. Pulling of strap 84 in the direction of the device 80 narrows the circumference of the loop created by said strap 84 and consequently applies pressure on said limb. Two additional examples of pressure gradient profiles are briefly presented in FIGS. 2A, 2B showing a central worm shaft 98, and cogwheels 113, 116. In FIG. 2A the shape of the cogwheel 116 is uneven thus providing a different pressure gradient profile to be used during the intermittent compression cycle on the limb. The cogwheel 116 of FIG. 2A provides a longer yet larger pulling of the strap 84 by the movement of pull rod 126 along substantially the entire axis 124 based on the shape of cogwheel 116. Alternatively, in FIG. 2B cogwheel 116 is rounded having quarter circular shapes having an ascending slope 138 and a sharp drop 140 there after enabling short but moderate release of the strap 84 and a swift and immediate pull of the strap when jointed rounded wheel 132 and pull rod 126 are pulled into recess 140 by means of spring 115. Persons skilled in the art will appreciate that by a single transformation of energy from spring 92 to cogwheel 116 a multitude of pressure gradient profiles can be applied to a user of device 80 depending on the required usage. While the embodiment depicted in FIGS. 2, 2', 2A, 2B associates the device 80 with a strap to be pulled in and out of housing 82, the present invention further contemplates the use of a compressible plate adjusted to the limb of the patient. Such plate can be rectangular, round, or limb shape oriented to fit the limb, and be placed on either side of the limb with the aid of straps (to allow attaching the device and the plate to the limb, but not necessarily encircling the limb) so as to apply intermittent compression.

Figure 5:
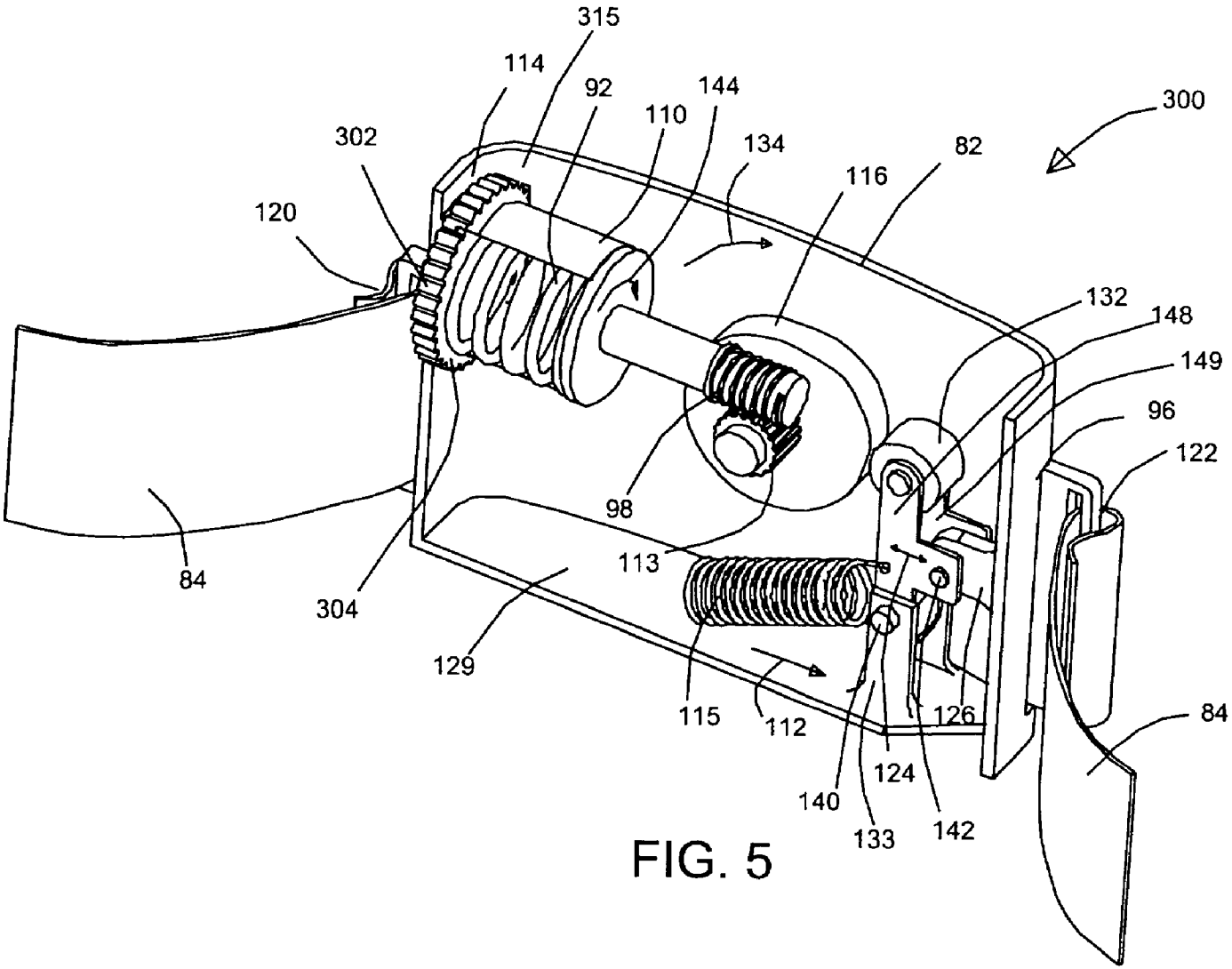
FIGS. 5 and 5A are views of a device for intermittent compression of a limb, according to a fifth preferred embodiment of the present invention.
Figure 5A:
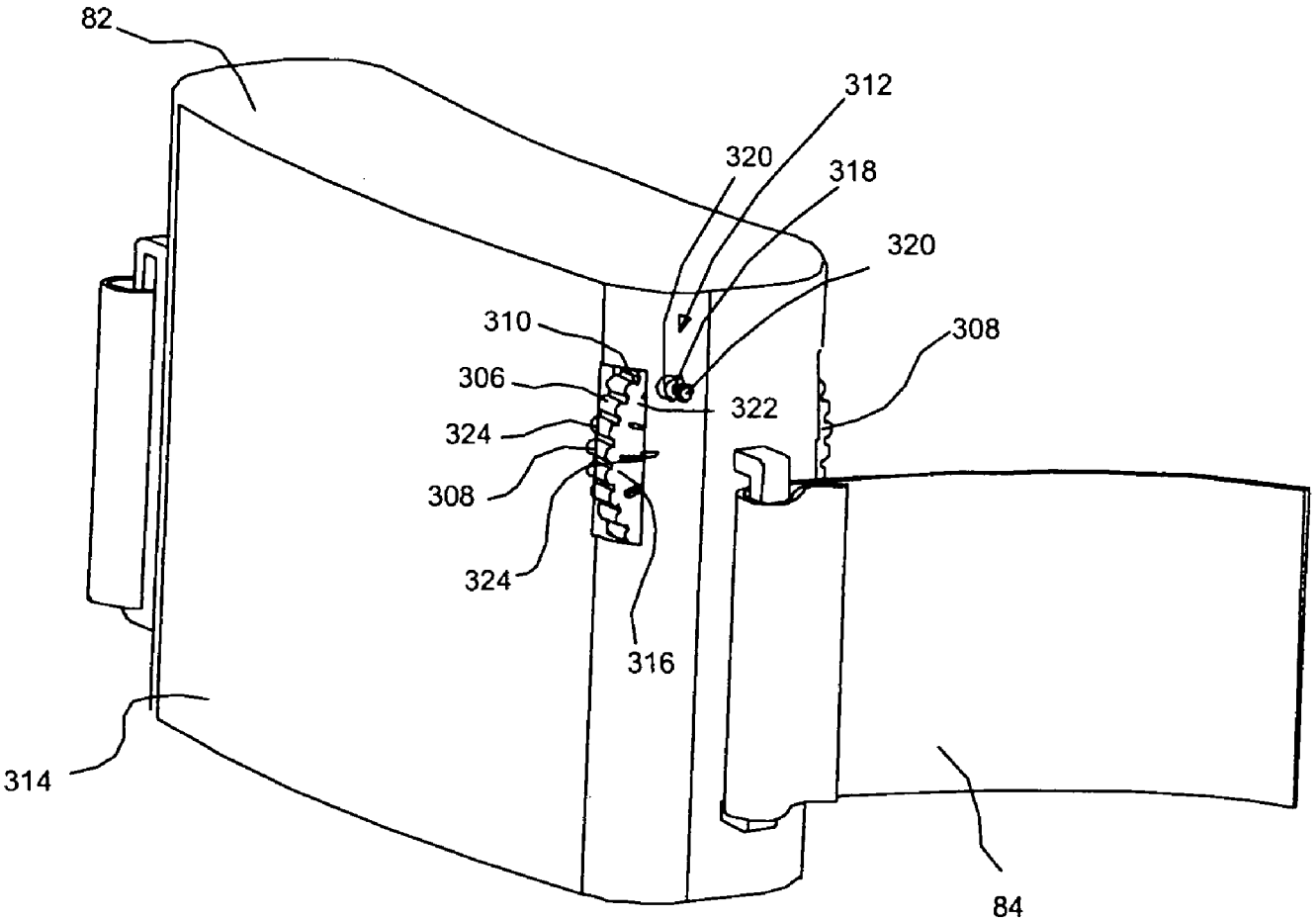

It will be realized that although in the above embodiments, the compression element is the strap or sleeve encircling the limb, the compression element may be a plate may be it will be realized that inflated, in other embodiments of the invention the compression element may be a compressing plate Another embodiment is provided in view of FIGS. 5 and 5A. FIGS. 5 and 5A are sectional view of a chargeable device for intermittent compression of a limb. FIGS. 5 and 5A illustrate a chargeable device 300 that comprises substantially the same elements comprised in FIG. 2 wherein cogwheel 116 is replaced with an uneven circular cogwheel depicted in view of FIG. 2A. Chargeable device 300 further comprises a charging cogwheel 302. Charging cogwheel 302 is projects from housing 82 through openings 306, 307 (not shown) within walls 314, 315, respectively. Cogwheel 302 is pivotally connected to wall 114 by a pivot 303 (not shown) attached to wall 114. Cogwheel 302 comprises bases 304, 316 and teeth 308. Base 316 comprises a number of depressions 324 spaced between, that are adjacent to the circumference of base 316. Coil 92 connected to base 304 juxtaposed to wall 114 of housing 82 at one end, and to a plunger 94 at the other end. Charging cogwheel 302 enables recharging of coil 92 with potential energy. Thus, cogwheel 302 provides reuse of device 300 for intermittent compression also after all previously stored energy within coil 92 was depleted. Typically, device 300 is provided with a charged coil 92 ready to use for intermittent compression. Accordingly, device 300 can be placed adjacent to a limb for initiating intermittent compression on said limb. After placing strap around limb the intermittent compression is initiated. The intermittent compression on limb continues as long as the intermittent compression is efficient, or alternatively, the intermittent compression is ceased, due to the remained diminished energy stored within coil 92. Cogwheel 302 enables recharging coil 92 thus enabling to restart intermittent compression on limb also after energy within coil 92 is depleted. Charging coil 92 is performed by turning cogwheel 302 in the opposite direction of arrow 144. Due to the fact that end of coil 92 is attached to base 308, coil 92 is charged when cogwheel 302 is turned. According to the preferred embodiment charging cogwheel 302 can charge coil 92 while straps 120, 122 are loose, or alternatively, not stretched around a limb. Nevertheless, One skilled in the art can easily comprehend the other embodiments can provide a chargeable device according to the present invention the charging energy of energy reservoir is performed while the straps are stretched on a limb. Other embodiments can comprise other charging elements for charging a coil or other energy reservoir such as lever charging a coil and the like. In still further embodiments the charger can be a combination of mechanical using electrical energy such as a battery moving a cogwheel or a lever and the like. Turning charging cogwheel 308 in the opposite direction of arrow 144 is done is performed manually by a user (not shown) as long as allowed by the elastic performance of coil 92. Chargeable device 300 comprises further a knob 312 that is place within opening 320 positioning in housing 82 adjacent to opening 306 and base 316. Knob 312 comprises an elongated element 318 and rounded push button top 322. Top 322 is wider than the width of element 318. Knob 312 is used to hold cogwheel 302 in its position or to provide its circular motion. Knob 312 can stop a motion of cogwheel 302 when pushed, thus element 318 placed within depression 324 does not allow motion of cogwheel 302. Due to the fact that coil 92 is connected to base 304 a charged coil 92 will not proceed transferring its energy to intermittent compression as depicted above when knob 312 is prevention motion of cogwheel 302. Similarly, the initiation of intermittent compression can be initiated when knob 312 is pulled out from depression 324.

Similarly to the depiction of FIGS. 4 and 4A above a device according to the embodiments depicted in FIGS. 2, 2A, 2B, 5 and 5A can be provided with a measuring device comprising a measuring sensor and a measuring display unit. According to one embodiment the sensor can be connected to a plunger such as plunger 94 in FIG. 2. Accordingly, an advancement of said coil can indicate by a lever connected to knob (not shown) placed on housing that can be viewed on the exterior of housing 82.

It will be realized that although the mechanisms described above, the compressing element is the strap or sleeve encircling the limb, in other modified embodiments of the invention, the compressing element may be a movable compressing plate fastened to the limb, such as described in International Publication WO02069879, the full content of which is incorporated herein by reference.

Figure 3:
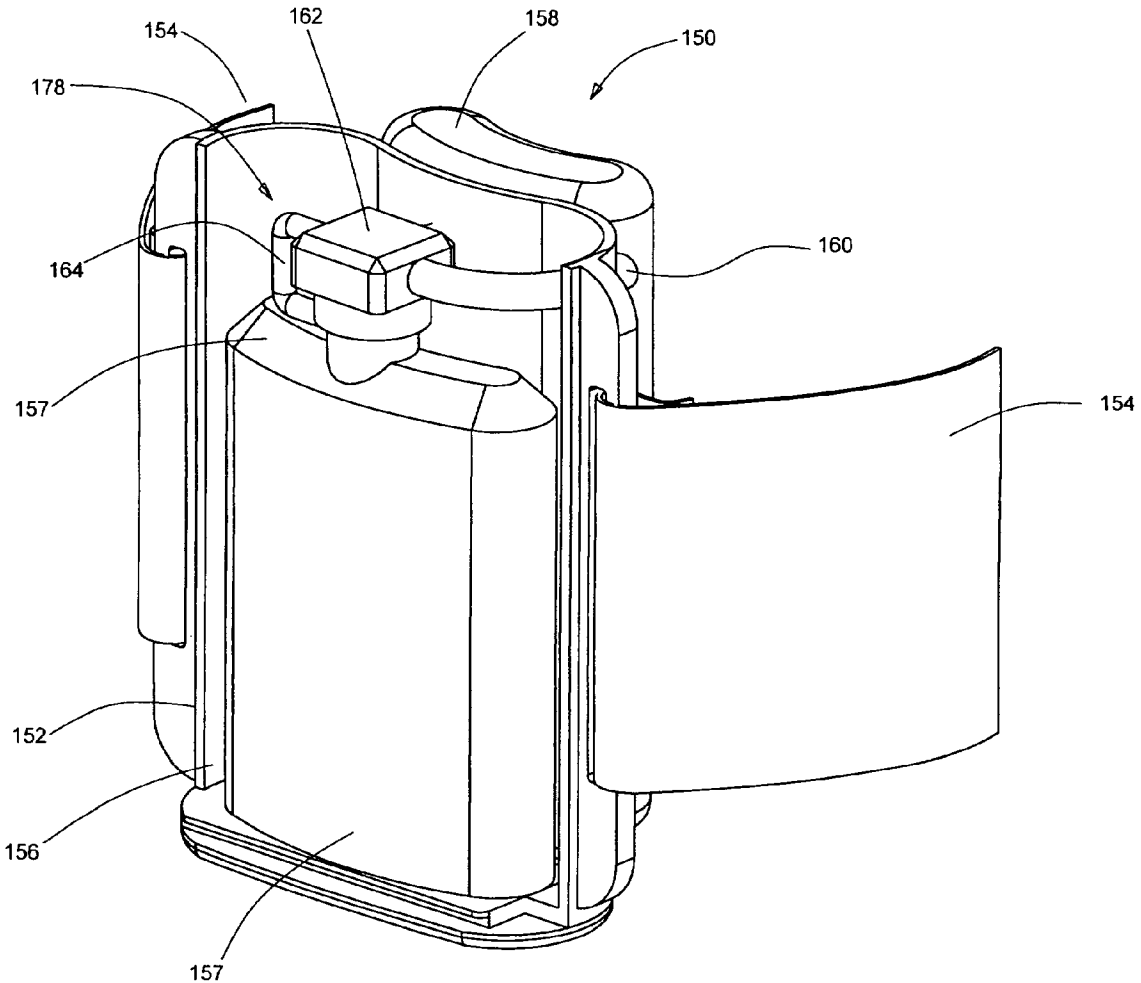
FIGS. 3, 3A and 3B are different view aspects of a device for intermittent compression of a limb, according to a third preferred embodiment of the present invention.
Figure 3B:
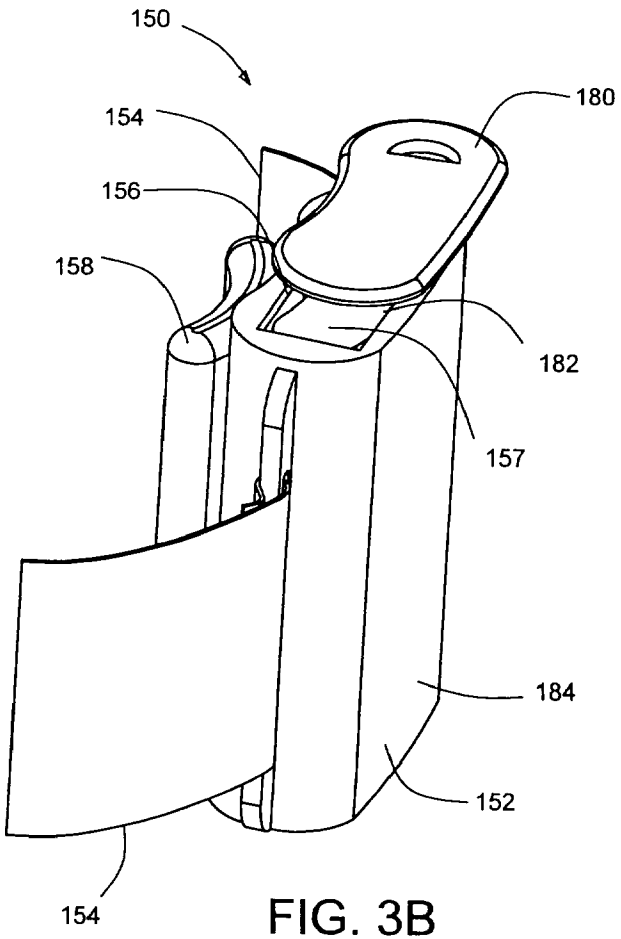
Figure 3A:
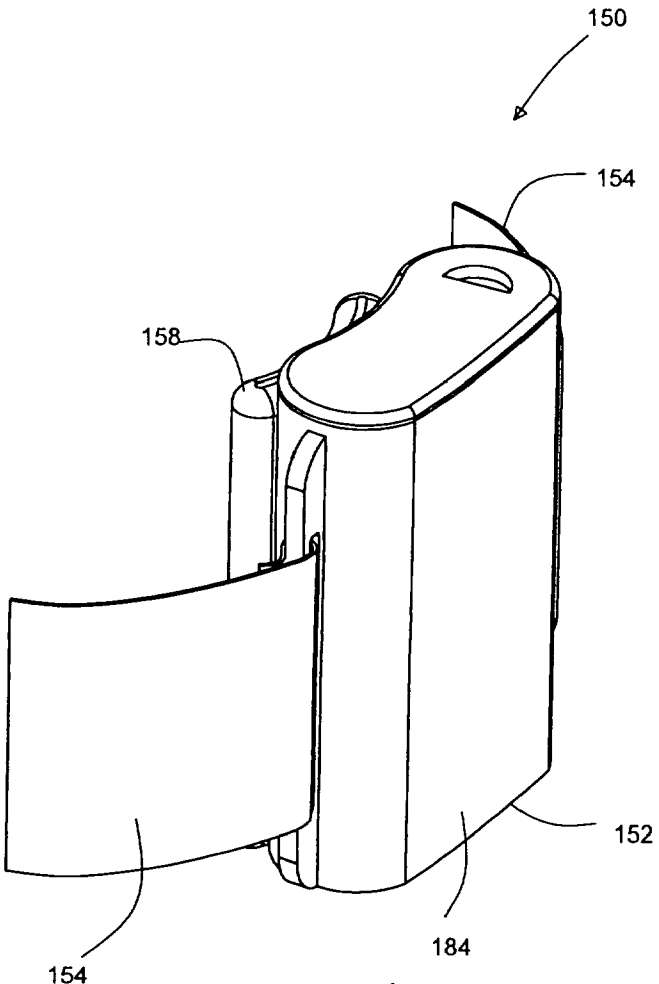

A further embodiment of the present invention can be seen in association with FIGS. 3, 3A and 3B that provide a side view, and bottom view of device 150 comprises housing 152 and strap 154. FIGS. 3 and 3A present housing 152 cut open without wall 184 (shown in FIGS. 3B and 3C). Housing 152 is placed juxtaposed to limb of a person (not shown) and strap 154 encircles said limb providing a loop (not shown). Housing 152 comprises an energy reservoir unit 156 having one or more compressed gas chambers 157, an energy releasing mechanism 178, and a bladder 158. Device 150 provides intermittent compression on a limb by deflating and inflating bladder 158 while straps 154 remain constant in circumference and hold the device 150 to the limb of the user. Thus, the intermittent contracting of loop 184 (not shown) encircling said limb is reached by intermittently providing gas in and out of bladder 158. The intermittent compression on limb is reached by intermittently providing bladder 158 with compressed gas from reservoir 156 and releasing air from bladder via bladder release opening 160. Energy reservoir unit 156 can be similar to energy reservoir 28 depicted in association with FIG. 1 above. Compressed gas stored within energy reservoir 157 can be released intermittently through the opening and closing of a moveable valve (not shown) operated by a pneumatic actuated valve mechanism provided with a steady stream of compressed gas through narrow pipe 164. The gas delivered to the pneumatic actuated valve mechanism 162 actuates intermittent opening and closing of the valve releasing air into bladder 158 and opening and closing of the valve releasing the gas within bladder 158 into bladder release opening 160. FIGS. 3B and 3C are the bottom view of device 150. Housing 152 comprises further opening 182 that provides inserting and extracting of energy reservoir 157. Accordingly, if the energy within energy reservoir 157 drops below a pre-designated level reservoir 157 can be replaced with another reservoir with the same dimension. Thus, according to the preferred embodiment if the pressure of gas within energy reservoir 157 is insufficient to inflate bladder 158 and provide required intermittent compression top 180 is removed from opening 182 and reservoir 157 is replaced with another reservoir. According to other embodiments removal of reservoir can be made from top, side, or bottom part of housing 152. The indication of insufficient intermittent compression can be indicated by a pressure measuring device as depicted above in view of FIGS. 4 and 4A, by the sensing of user of device 150, or other means. Reservoir 157 can be disposed or reused by inserting pressured gas. One skilled in the art can appreciate that different energy reservoirs can be used in association with the embodiments depicted above or like embodiments. Such energy reservoirs can include in addition to the depicted reservoirs chambers comprising gas generated there within through chemical processes, electromagnetic, electrical, magnetic, mechanical temperature related energy and the like. Likewise, more than one energy reservoir can be used in association with a single device. The energy reservoir can be disposable and be replaced when depleted by pulling the energy reservoir cartridge from the intermittent compression device and inserting a new cartridge comprising an energy reservoir into the intermittent compression device. Alternatively, the device itself can be disposable once the energy reservoir it is manufactured with has been depleted. In yet another embodiment of the present invention a small timing mechanism can control the timing of the release of the energy thus better controlling the intermittent intervals and the energy gradient profiles set for the device by a user or the manufacturer.

Persons skilled in the art will readily perceive that the present invention is not limited to the specific embodiments or examples shown above, rather to the claims which follow.

I claim:

1. A device for providing intermittent compression to a limb, the device comprising:

at least one energy reservoir comprising at least one charged spring; and at least one compressing means for compressing the limb;

wherein energy stored in the at least one energy reservoir is substantially directly transferred to effectuate multiple compression-relaxation cycles on the limb through the at least one compressing means without recharging said spring between consecutive cycles; and wherein the energy stored in the at least one energy reservoir is transferred in portions such that each of said portions effectuates at least one of said multiple compression-relaxation cycles.

2. The device of claim 1 wherein energy transferred from the at least one energy reservoir is regulated.

3. The device of claim 1 wherein the at least one compressing means for compressing the limb is a strap encircling the limb, the strap comprising a first end and a second end.

4. The device of claim 1 further comprising an energy transfer control mechanism.

5. The device of claim 1 wherein the device further comprises an at least one energy release mechanism.

6. The device of claim 5 wherein the at least one energy release mechanism comprises at least one cogwheel.

7. The device of claim 1 wherein the device is portable.

8. The device of claim 1 wherein the device is disposable.

9. The device of claim 1 wherein the device is used for enhancing blood and lymph flow.

10. The device of claim 1 wherein the device is a chargeable device.

11. The device of claim 10 wherein the device comprises further a chargeable energy reservoir.

12. The device of claim 10 wherein the device comprises at least one charging element for charging said device.

13. The device of claim 12 wherein the charging element is mechanical.

14. The device of claim 12 wherein the charging element comprises at least one cogwheel.

15. The device of claim 10 wherein the charging of the device can be performed while said device is adjacent to the limb.

16. The device of claim 10 wherein the charging of the device provides a reuse of said device for intermittent compression on limb.

17. The device of claim 1 wherein said at least one spring is a coil.

18. The device of claim 1 wherein the device comprises at least one measuring device.

19. The device of claim 18 wherein the at least one measuring device comprises a display unit.

20. The device of claim 18 wherein the at least one measuring device indicates the intermittent compression capability of the device.

21. The device of claim 18 wherein the measuring device measures the energy stored within the energy reservoir.

22. The device of claim 18 wherein the measuring device indicates the time remaining for intermittent compression on said limb.

23. The device of claim 18 wherein the measuring device indicates the time of intermittent compression applied on said limb.

24. A method for providing intermittent compression to a limb, the method comprising providing at least one energy reservoir and at least one compressing means for compressing the limb wherein said energy reservoir comprises at least one charged spring; and transferring energy stored in the at least one energy reservoir directly to multiple compression-relaxation cycles on the limb through the at least one compressing means without recharging said spring between consequent cycles, wherein the energy stored in the at least one energy reservoir is transferred in portions such that each of said portions effectuates at least one of said multiple compression-relaxation cycles.

* * * * *